US011306745B2

(12) United States Patent
Barras

(10) Patent No.: US 11,306,745 B2
(45) Date of Patent: Apr. 19, 2022

(54) ACCUMULATOR

(71) Applicant: Eaton Intelligent Power Limited, Dublin (IE)

(72) Inventor: Guillaume Barras, Viroflay (FR)

(73) Assignee: EATON INTELLIGENT POWER LIMITED, Dublin (IE)

( * ) Notice: Subject to any disclaimer, the term of this patent is extended or adjusted under 35 U.S.C. 154(b) by 329 days.

(21) Appl. No.: 16/474,107

(22) PCT Filed: Dec. 21, 2017

(86) PCT No.: PCT/EP2017/084175
§ 371 (c)(1),
(2) Date: Jun. 27, 2019

(87) PCT Pub. No.: WO2018/122111
PCT Pub. Date: Jul. 5, 2018

(65) Prior Publication Data

US 2020/0248717 A1 Aug. 6, 2020

(30) Foreign Application Priority Data

Dec. 27, 2016 (EP) ..... 16306823

(51) Int. Cl.
*F15B 1/24* (2006.01)
*F15B 20/00* (2006.01)

(52) U.S. Cl.
CPC ..... *F15B 1/24* (2013.01); *F15B 20/00* (2013.01); *F15B 20/004* (2013.01); (Continued)

(58) Field of Classification Search
CPC .... F15B 1/24; F15B 2201/31; F15B 2201/41; F15B 2201/405; F15B 2201/415; F15B 2201/205; F15B 2201/312
(Continued)

(56) References Cited

U.S. PATENT DOCUMENTS 2,417,873 A * 3/1947 Huber ..... F15B 1/24 138/31
2,715,419 A * 8/1955 Ford ..... F16L 55/052 138/31

(Continued)

FOREIGN PATENT DOCUMENTS

DE 20102031 U1 4/2001
EP 2514976 A2 10/2012
GB 2148397 A 5/1985

*Primary Examiner* — Patrick F Brinson
(74) *Attorney, Agent, or Firm* — Merchant & Gould P.C.

(57) ABSTRACT

An accumulator includes: a main cylindrical housing having a closed first axial end and a second axial end; a piston arranged in the main cylindrical housing and sealed to an inner surface of the main cylindrical housing, which piston is movable in an axial direction and provides with the main cylindrical housing and the closed first axial end of the main cylindrical housing a variable accumulating space; an urging device arranged between the piston and the second axial end of the main cylindrical housing for urging the piston towards the first axial end of the main cylindrical housing; a fluid supply opening arranged in the first axial end of the main cylindrical housing, which fluid supply opening is in fluid connection with the variable accumulating space; and a protective cylindrical housing having a first and a second axial end, the protective cylindrical housing being arranged concentrically.

7 Claims, 2 Drawing Sheets

(52) U.S. Cl.
CPC ..... *F15B 20/005* (2013.01); *F15B 2201/20* (2013.01); *F15B 2201/31* (2013.01); *F15B 2201/40* (2013.01); *F15B 2201/405* (2013.01); *F15B 2211/62* (2013.01); *F15B 2211/8606* (2013.01)

(58) Field of Classification Search
USPC ..... 138/31, 30, 26
See application file for complete search history.

(56) References Cited

U.S. PATENT DOCUMENTS 2,742,929 A * 4/1956 Treseder ..... F15B 1/24 138/31
2,829,672 A * 4/1958 Bleasdale ..... F15B 1/24 138/31
3,004,561 A 10/1961 Henry
4,566,609 A * 1/1986 Hoffmeister ..... F02K 9/605 138/31
7,108,016 B2 * 9/2006 Moskalik ..... F15B 1/24 138/31
7,661,442 B2 * 2/2010 O'Brien, II ..... B60K 6/12 138/31
8,020,587 B2 * 9/2011 Gray, Jr. ..... F15B 1/024 138/31
8,608,014 B2 12/2013 Mueller
8,899,270 B2 * 12/2014 Engelberg ..... F15B 1/24 138/31
9,581,278 B2 * 2/2017 Condon ..... F16L 55/053
10,330,124 B2 * 6/2019 Baltes ..... F15B 1/24

* cited by examiner

ACCUMULATOR

CROSS-REFERENCE TO PRIOR APPLICATIONS

This application is a U.S. National Phase application under 35 U.S.C. § 371 of International Application No. PCT/EP2017/084175, filed on Dec. 21, 2017, and claims benefit to European Patent Application No. EP 16306823.2, filed on Dec. 27, 2016. The International Application was published in English on Jul. 5, 2018 as WO 2018/122111 under PCT Article 21(2).

FIELD

The invention relates to an accumulator comprising:

- a main cylindrical housing having a closed first axial end and a second axial end;
- a piston arranged in the main cylindrical housing and sealed to the inner surface of the main cylindrical housing, which piston is movable in axial direction and provides with the main cylindrical housing and the closed first axial end of the main cylindrical housing a variable accumulating space;
- an urging device arranged between the piston and the second axial end of the main cylindrical housing for urging the piston towards the first axial end of the main cylindrical housing;
- a fluid supply opening arranged in the first axial end of the main cylindrical housing, which fluid supply opening is in fluid connection with the variable accumulating space. Such accumulators are used in a number of applications to maintain pressure in a hydraulic system. In particular in an aircraft a number of accumulators are used to ensure proper functioning of the different hydraulic systems.

BACKGROUND

Typically, the urging device is embodied as a pressurized gas present on the opposite side of the piston, but could also be a coil spring or the like.

When such a prior art accumulator is subjected to heat, for example during operation of the airplane or in case of fire, the gas and hydraulic fluid inside of the accumulator is heated quickly via the main cylindrical housing wall. This impairs functioning of the accumulator.

It could also occur that the accumulator has to take an impact, which results in a dent or even a crack in the wall of the cylindrical housing. A dent will prevent the piston from proper functioning, as the dent will prevent full axial movement of the piston and could also cause the typical seal on the piston not to function properly, such that hydraulic fluid can flow past the piston.

Furthermore, it could occur that due to stresses in the accumulator, a weld malfunctions or the wall of the cylindrical housing cracks and pressurized gas leaks into the airplane.

One could chose to strengthen the prior art accumulators by increasing the wall thickness, however, this would also increase the weight of the accumulator, which is typically disadvantageous for an airplane.

SUMMARY

In an embodiment, the present invention provides an accumulator, comprising: a main cylindrical housing having a closed first axial end and a second axial end; a piston arranged in the main cylindrical housing and sealed to an inner surface of the main cylindrical housing, which piston is movable in an axial direction and provides with the main cylindrical housing and the closed first axial end of the main cylindrical housing a variable accumulating space; an urging device arranged between the piston and the second axial end of the main cylindrical housing configured to urge the piston towards the first axial end of the main cylindrical housing; a fluid supply opening arranged in the first axial end of the main cylindrical housing, which fluid supply opening is in fluid connection with the variable accumulating space; and a protective cylindrical housing having a first and a second axial end, the protective cylindrical housing being arranged concentrically with and spaced apart from the main cylindrical housing, the protective cylindrical housing being arranged with its first axial end to the first axial end of the main cylindrical housing, and the second axial end of the protective cylindrical housing being closed and spaced apart from the second axial end of the main cylindrical housing.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

Figure 1:
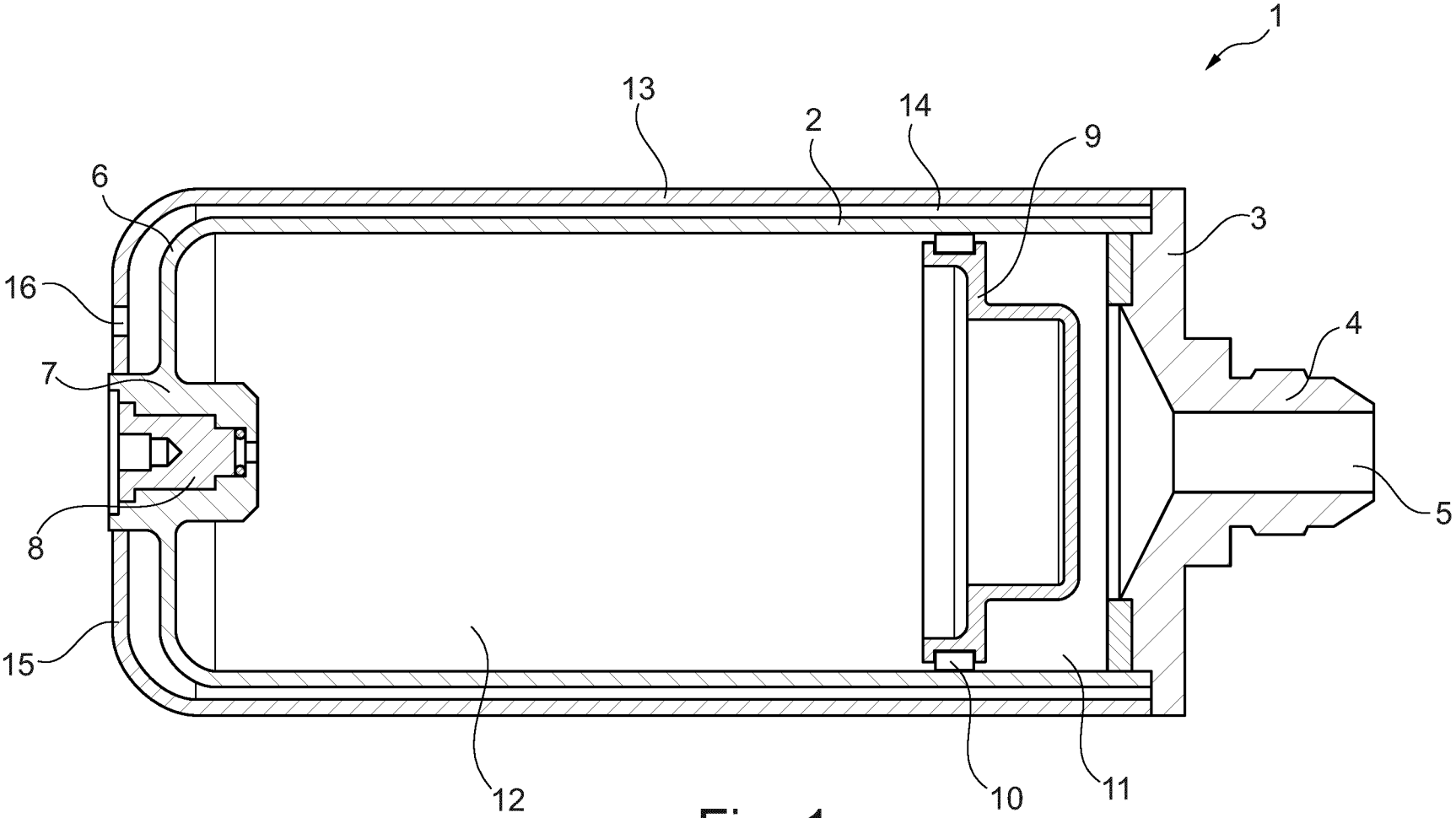
FIG. 1 shows a cross-sectional view of an embodiment of an accumulator 1 according to the invention.
Figure 2:
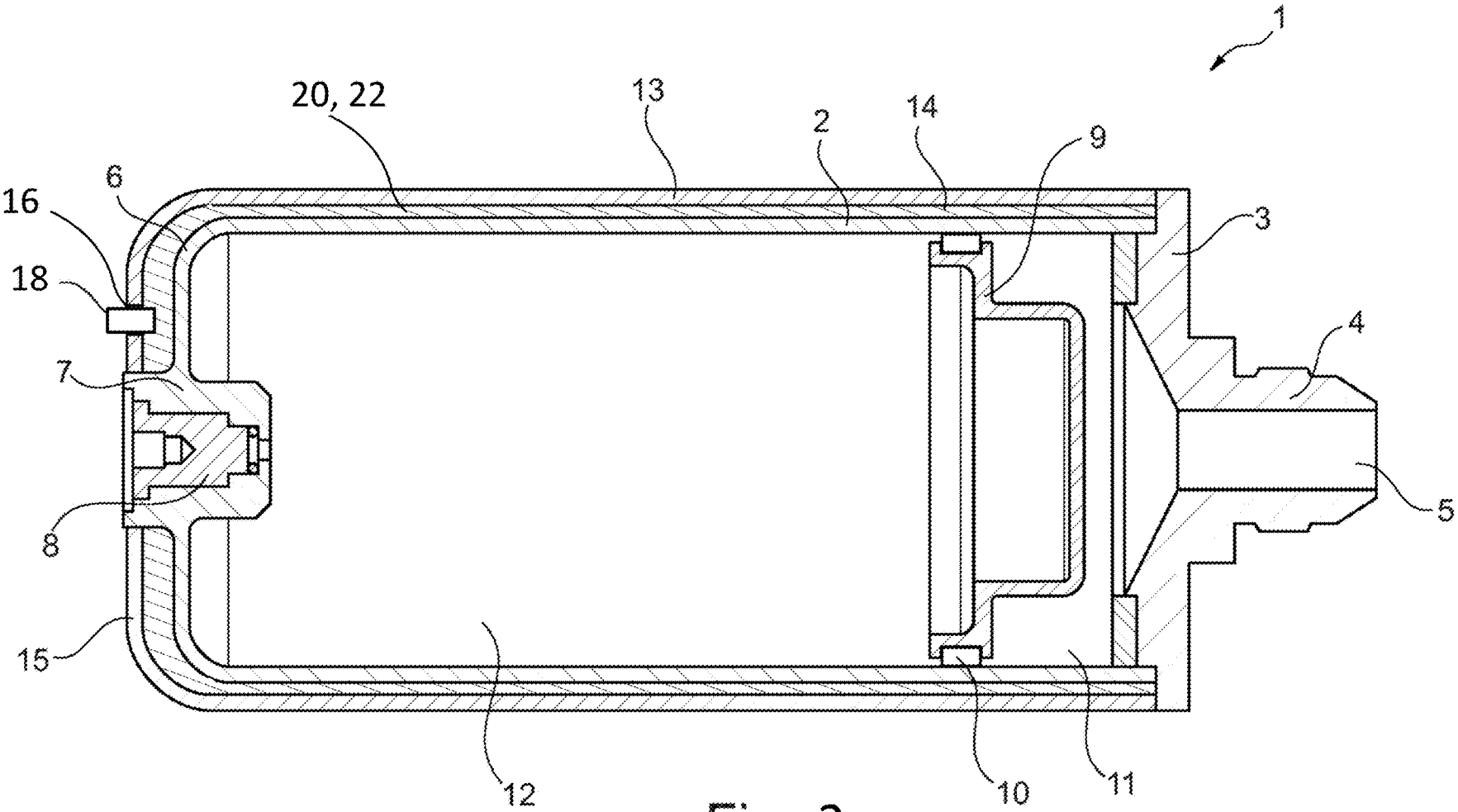
FIG. 2 shows a cross-sectional view of the accumulator of FIG. 1 with a one-way valve provided at a hole of a protective cylindrical housing.

The accumulator 1 has a main cylindrical housing 2, which is closed on the first axial end by an adapter plate 3, which is provided with an adapter 4 with a passage 5 for connection with a hydraulic system.

DETAILED DESCRIPTION

Therefore, in an embodiment the present invention reduces or even removes the above mentioned disadvantages.

In an embodiment the present invention provides an accumulator, which is characterized by a protective cylindrical housing having a first and second axial end, wherein the protective cylindrical housing is arranged concentrically with and spaced apart from the main cylindrical housing, wherein the protective cylindrical housing is arranged with the first axial end to the first axial end of the main cylindrical housing and wherein the second axial end of the protective cylindrical housing is closed and spaced apart from the second axial end of the main cylindrical housing.

With the protective cylindrical housing a lightweight solution is provided which protects the accumulator from heat, impacts and prevents that in case of leakage of the accumulator the fluids flow into the aircraft or other space, where the accumulator is arranged.

The protective cylindrical housing shields the main cylindrical housing from heat, because the space between both housings provides a thermal barrier.

When the accumulator according to the invention suffers an impact, the dent and possible crack will be formed in the protective cylindrical housing, while the main cylindrical housing remains unaffected due to the spacing between the protective housing and the main housing.

Furthermore, when a crack occurs due to stresses in the main cylindrical housing and the gas or hydraulic fluid would leak, then these fluids will be contained by the protective cylindrical housing.

In an embodiment of the accumulator according to the invention a hole is arranged in the protective cylindrical housing, preferably in the closed second axial end.

The hole in the protective cylindrical housing ensures that no pressure difference can occur between the ambient pressure and the pressure in the space between the protective cylindrical housing and the main cylindrical housing.

In another embodiment of the accumulator according to the invention a one way valve is arranged in the hole. The one way allows for the space between the protective cylindrical housing and the main cylindrical housing to be pressurized and be filed with a desired type of fluid.

Preferably, the space between the protective cylindrical housing and the main cylindrical housing is vacuumized. When a leak would occur in the main cylindrical housing, the vacuumized space would absorb the leaked fluid.

In yet another embodiment of the accumulator according to the invention, a fire extinguishing substance, such as an inert gas or an expansive foam, is arranged in the space between the protective cylindrical housing and the main cylindrical housing.

In case of fire the inert gas can flow out of a crack in the protective cylindrical housing to reduce the fire, while an expansive foam can provide an additional protection of the main cylindrical housing.

In yet another embodiment of the accumulator according to the invention the second axial end of the main cylindrical housing is closed to provide with the main cylindrical housing and the piston pressure chamber and wherein the urging device comprises a pressurized gas arranged in the pressure chamber.

Using a pressurized gas allows for a accumulator according to the invention to be easily set to a desired counter pressure. If a spring is used, then the spring has to be exchanged when a different counter pressure is desired.

Preferably, the accumulator according to the invention comprises a fluid port extending through the closed second axial end of the protective cylindrical housing and the closed second axial end of the main cylindrical housing, which fluid port is for filling and pressurizing the pressure chamber.

The second axial end 6 of the main cylindrical housing 2 is provided with a fluid port 7 which is sealed by a plug 8.

A piston 9 is axially movable arranged in the main cylindrical housing 2 and is provided with a seal 10 for sealing against the inner wall of the housing 2. The piston 9 divides the inner space of the main cylindrical housing 2 into an accumulating space 11 and a pressure chamber 12.

The pressure chamber 12 is preferably filled with a pressurized gas via the fluid port 7 and ensures that the piston 9 is urged towards the adapter 4. When the adapter 4 is connected to a hydraulic system, fluid will flow via the passage 5 into the accumulating space 11 and push the piston 9 towards the second end 6. This allows for the hydraulic system to maintain a certain pressure.

A protective cylindrical housing 13 is arranged concentrically to the main cylindrical housing 2. A space 14 is provided between both protective cylindrical housing 13 and the main cylindrical housing 2. The first axial end of the protective cylindrical housing 13 is sealed to the adapter plate 3, while the second axial end 15 of the protective cylindrical housing 13 is closed and has the fluid port 7 extending there through.

The closed second axial end 15 of the protective cylindrical housing 13 is provided with a hole 16, which is in fluid connection with the space 14 and allows for pressure equalization. This hole 16 could be provided with a one-way valve 18 to vacuumize the space 14 or to provide a pressurized gas 20 or an expandable foam 22 in the space 14.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An accumulator, comprising:

a main cylindrical housing having a closed first axial end and a second axial end;

a piston arranged in the main cylindrical housing and sealed to an inner surface of the main cylindrical housing, which piston is movable in an axial direction and provides with the main cylindrical housing and the closed first axial end of the main cylindrical housing a variable accumulating space;

an urging device arranged between the piston and the second axial end of the main cylindrical housing configured to urge the piston towards the first axial end of the main cylindrical housing;

a fluid supply opening arranged in the first axial end of the main cylindrical housing, which fluid supply opening is in fluid connection with the variable accumulating space;

a protective cylindrical housing having a first and a second axial end, the protective cylindrical housing being arranged concentrically with and spaced apart from the main cylindrical housing, the protective cylindrical housing being arranged with its first axial end to the first axial end of the main cylindrical housing, and the second axial end of the protective cylindrical housing being closed and spaced apart from the second axial end of the main cylindrical housing, wherein a hole is arranged in the protective cylindrical housing; and a one way valve arranged in the hole.

2. The accumulator according to claim 1, wherein the space between the protective cylindrical housing and the main cylindrical housing is vacuumized.

3. The accumulator according to claim 1, further comprising a fire extinguishing substance comprising an inert gas or an expansive foam arranged in the space between the protective cylindrical housing and the main cylindrical housing.

4. The accumulator according to claim 1, wherein the second axial end of the main cylindrical housing is closed to provide a piston pressure chamber, and wherein the urging device comprises a pressurized gas arranged in the pressure chamber.

5. The accumulator according to claim 4, further comprising a fluid port extending through the closed second axial end of the protective cylindrical housing and the closed second axial end of the main cylindrical housing, which fluid port is configured to enable filling and pressurizing of the pressure chamber.

6. The accumulator according to claim 1, wherein the hole is arranged in the protective cylindrical housing in the closed second axial end.

7. The accumulator according to claim 2, further comprising a fire extinguishing substance comprising an inert gas or an expansive foam arranged in the space between the protective cylindrical housing and the main cylindrical housing.

* * * * *